US007410370B2

(12) United States Patent
Sprouse et al.

(10) Patent No.: US 7,410,370 B2
(45) Date of Patent: Aug. 12, 2008

(54) ELECTRICAL CONNECTOR WITH ESD GROUNDING CLIP

(75) Inventors: Steven Sprouse, San Jose, CA (US); Patricio Collantes, San Jose, CA (US); Dhaval Parikh, Santa Clara, CA (US)

(73) Assignee: SanDisk Corporation, Milpitas, CA (US)

( * ) Notice: Subject to any disclaimer, the term of this patent is extended or adjusted under 35 U.S.C. 154(b) by 0 days.

(21) Appl. No.: 11/618,280

(22) Filed: Dec. 29, 2006

(65) Prior Publication Data

US 2008/0160831 A1 Jul. 3, 2008

(51) Int. Cl.
*H01R 4/66* (2006.01)

(52) U.S. Cl. ..... 439/95

(58) Field of Classification Search ..... 439/95, 439/96, 181

See application file for complete search history.

(56) References Cited

U.S. PATENT DOCUMENTS 4,738,628 A * 4/1988 Rees ..... 439/95
4,889,497 A * 12/1989 Riches ..... 439/76.1
5,149,224 A * 9/1992 Smith ..... 404/6
5,240,424 A * 8/1993 Honma et al. ..... 439/95
5,749,741 A * 5/1998 Bellas et al. ..... 439/95
5,893,766 A * 4/1999 Bellas et al. ..... 439/95
5,906,496 A * 5/1999 DelPrete et al. ..... 439/95
6,074,223 A * 6/2000 Huang ..... 439/95
6,142,795 A * 11/2000 Kieninger et al. ..... 439/95
6,702,616 B1 * 3/2004 Chang et al. ..... 439/607
6,733,810 B2 * 5/2004 Roth ..... 426/319
6,780,068 B2 * 8/2004 Bartholoma et al. ..... 439/752
6,854,984 B1 2/2005 Lee et al.
7,108,560 B1 9/2006 Chou et al.
2002/0048976 A1 4/2002 Zhu et al.
2003/0157836 A1 8/2003 Morikawa et al.

OTHER PUBLICATIONS

U.S. Appl. No. 11/618,292, filed Dec. 29, 2006.
Vinson et al., "Electrostatic Discharge in Semiconductor Devices: An Overview", Proceedings of the IEEE, vol. 86, No. 2, Feb. 1998, pp. 399-418.
International Search Report and Written Opinion mailed May 9, 2008, International Application No. PCT/US2007/088838.

* cited by examiner

*Primary Examiner*—Gary F. Paumen
(74) *Attorney, Agent, or Firm*—Vierra Magen Marcus & DeNiro LLP

(57) ABSTRACT

A connector is disclosed for preventing electrostatic discharge during connection of a USB-type connector. The connector includes a grounding clip provided within a recess formed at least partially down into the surface of the second level of the base block. The grounding clip may have a proximal end affixed to a proximal end of a signal ground pin of the plurality of signal pins, though the grounding clip and signal ground pin may be coupled at other locations along their lengths. The connector including the grounding clip may be affixed to a semiconductor device. A portion of the grounding clip is provided at a height above the surface of the base block such that, when a shroud is slid around the connector, the shroud engages and remains in contact with the grounding clip. Accordingly, any electrostatic discharge built up in the shroud travels from the shroud, through the ESD grounding clip, to the signal ground pin where it is harmlessly dissipated.

20 Claims, 4 Drawing Sheets

Fig. 4
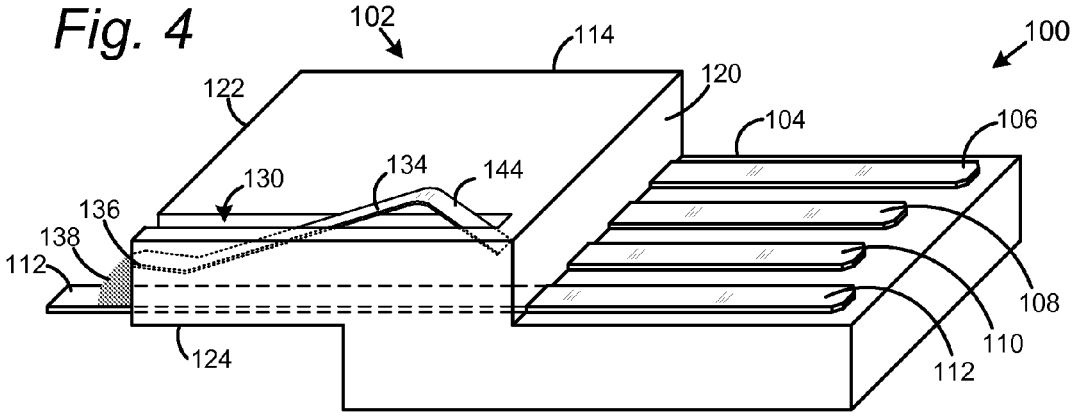
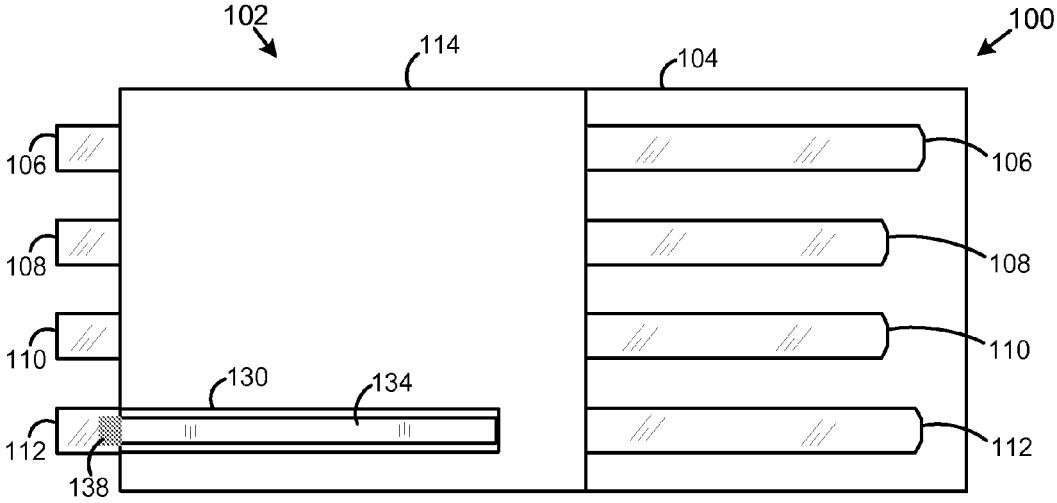
Fig. 5
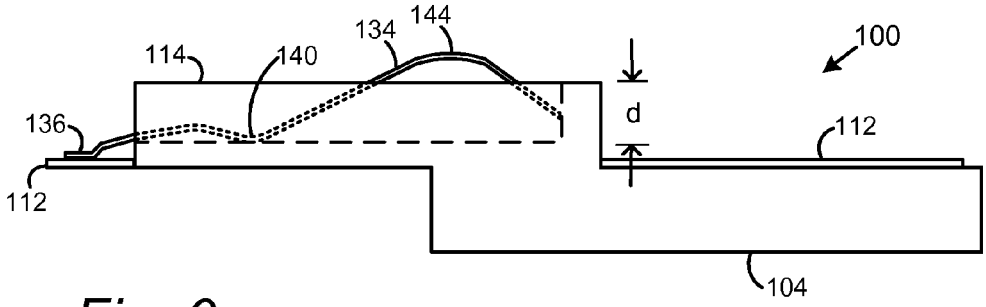
Fig. 6

ELECTRICAL CONNECTOR WITH ESD GROUNDING CLIP

CROSS-REFERENCE TO RELATED APPLICATIONS

The following application is related to U.S. patent application Ser. No. 11/618,292, entitled "Method of Making an Electrical Connector with ESD Grounding Clip," by Steven Sprouse et al. filed the same day as the present application, which application is incorporated herein by reference in its entirety.

BACKGROUND OF THE INVENTION

1. Field of the Invention

Embodiments of the present invention relate to a method of preventing electrostatic discharge during connection of a USB-type connector, and a USB-type connector formed thereby.

2. Description of the Related Art

The strong growth in demand for portable consumer electronics is driving the need for high-capacity storage devices. Non-volatile semiconductor memory devices, such as flash memory storage cards, are becoming widely used to meet the ever-growing demands on digital information storage and exchange. Their portability, versatility and rugged design, along with their high reliability and large storage capacity, have made such memory devices ideal for use in a wide variety of electronic devices, including for example digital cameras, digital music players, video game consoles, PDAs and cellular telephones.

Equally ubiquitous is the universal serial bus (USB) interface for transferring signals between devices such as those named above and other components such as for example desktop computers and the like. The USB interface is comprised of a male plug and female socket connectors. Plugs generally have one or more pins that are inserted into openings in the mating socket. While there are several types of USB connectors, the most commonly used is the type-A plug on which is a 4-pin connector, surrounded by a shield. A conventional type-A USB plug and socket are shown in cross-section in prior art FIGS. 1 through 3. The conventional USB plug 20 shown in FIG. 1 may for example be attached to an electronic device and includes a base 22 on which is formed a signal power pin 24, a pair of signal pins 26, 28 and a signal ground pin 30. The base and pins are covered by a shroud 32. The conventional USB socket 36 may be incorporated in a host device and includes a base 38 and four terminals 40 through 46 formed thereon. As seen in FIG. 3, the plug may be received within the socket with pins 24 through 30 mating with pins 40 through 46 to allow transfer of signals between the electronic and host devices.

In conventional USB connections, the shroud is electrically coupled to the signal ground pin through an established circuit path in the electronic device. In particular, once affixed around the base 22 and pins 26 through 30, the shroud may typically be soldered to a printed circuit board at a location coupled to the signal ground pin. One of the functions of the electrical coupling of the shroud to ground is to prevent electrostatic discharge (ESD) between the shroud and portions of the circuit of the electronic device. In particular, where the shroud and electronic circuit are at different electrical potentials (for example due to static electrical build-up in the shroud), an electrostatic charge may jump from the shroud onto the electronic circuit, where the electrostatic charge may damage semiconductor components in the circuit.

As indicated, where the shroud is grounded, electrostatic charge in the shroud may be discharged harmlessly through the grounded connection. However, it is currently known to provide USB connective semiconductor devices where a shroud is included, but is not soldered to the printed circuit board and has no ground connection. Such devices run the risk of damage due to ESD between the shroud and electronic circuit.

SUMMARY OF THE INVENTION

One embodiment relates to a method of preventing electrostatic discharge during connection of a USB-type connector, and a USB-type connector formed thereby. The connector includes a split-level base block, a first level of which includes a plurality of signal pins, and a second level of which includes an ESD grounding clip. The grounding clip may be provided within a recess formed at least partially down into the surface of the second level of the base block. The grounding clip may have a proximal end affixed to a proximal end of a signal ground pin of the plurality of signal pins, though the grounding clip and signal ground pin may be coupled at other locations along their lengths.

The connector including the grounding clip may be affixed to a semiconductor device. In embodiments, a shroud may be affixed around the connector and, possibly, around the semiconductor device. A portion of the grounding clip is provided at a height above the surface of the base block such that, as the shroud is slid around the base block, the shroud engages and remains in contact with the grounding clip. Accordingly, any electrostatic discharge built up in the shroud travels from the shroud, through the ESD grounding clip, to the signal ground pin where it is harmlessly dissipated.

DESCRIPTION OF THE DRAWINGS

FIG. 4 is a perspective view of a USB plug without a shroud according to an embodiment of the present invention.

FIG. 5 is a top view of the embodiment shown in FIG. 4.

FIG. 6 is an edge view of the embodiment shown in FIG. 4.

DETAILED DESCRIPTION

Figure 1:
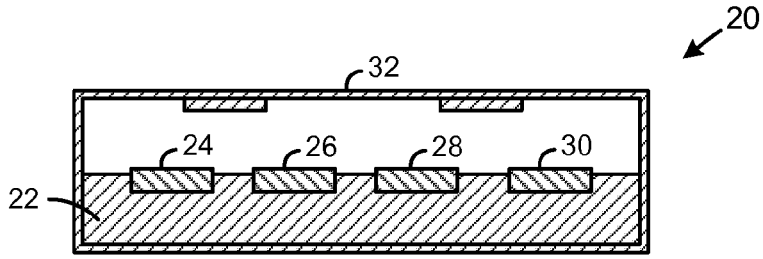
Fig. 1 (Prior Art)
FIG. 1 is a cross-sectional view of a conventional type-A USB plug.
Figure 2:
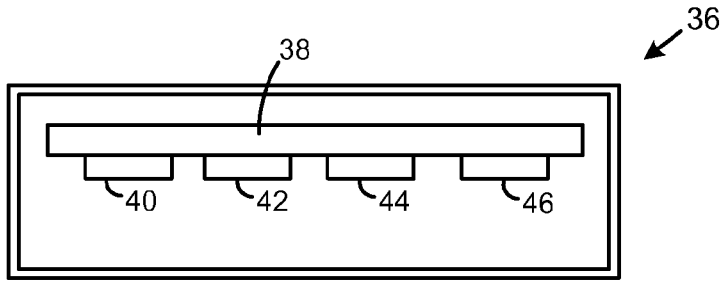
Fig. 2 (Prior Art)
FIG. 2 is a cross-sectional view of a conventional type-A USB socket.
Figure 3:
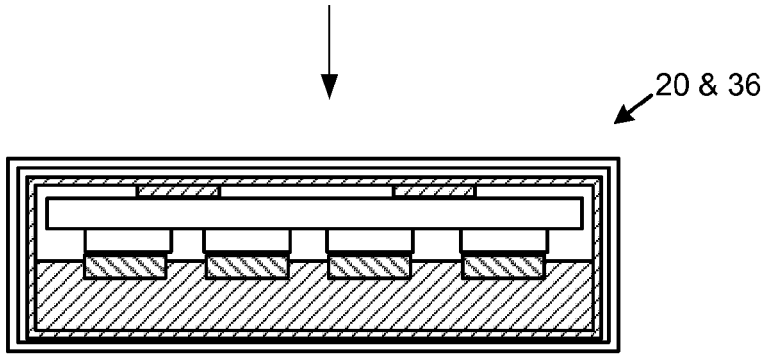
Fig. 3 (Prior Art)
FIG. 3 is a cross-sectional view of a conventional type-A USB plug inserted within a type-A USB socket.
Figure 7:
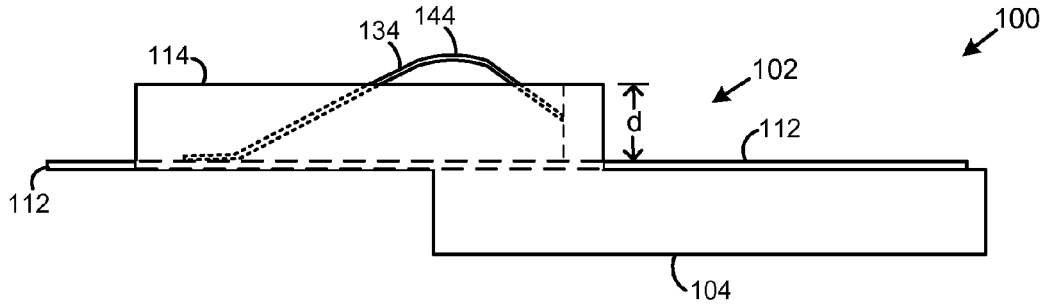
FIG. 7 is an edge view of a USB plug without a shroud according to an alternative embodiment of the present invention.
Figure 8:
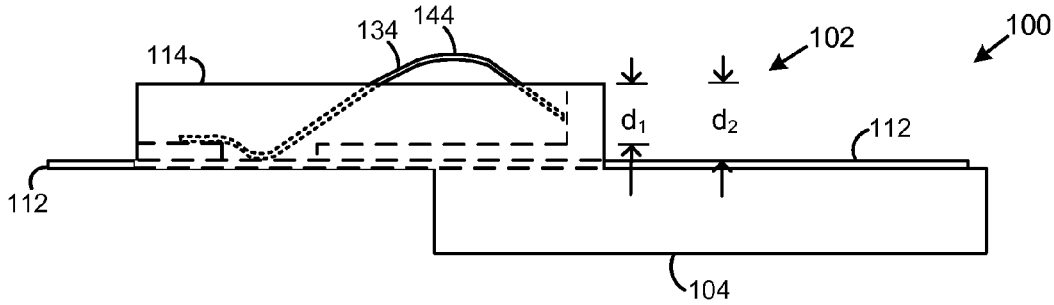
FIG. 8 is an edge view of a USB plug without a shroud according to a further embodiment of the present invention.

Embodiments will now be described with reference to FIGS. 4 through 12, which relate to a method of preventing electrostatic discharge during connection of a USB-type connector, and a USB-type connector formed thereby. It is understood that the present invention may be embodied in many different forms and should not be construed as being limited to the embodiments set forth herein. Rather, these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

Referring initially to the perspective, top and edge views of FIGS. 4-6, respectively, there is shown a USB connector 100, without a shroud, according to an embodiment of the present invention. The connector 100 shown is for a type-A USB connection, but it is contemplated that other types of USB connectors may include the present invention as described hereinafter. Connector 100 includes a split-level base block 102 including a first level 104 and a second level 114 integrally formed or affixed to level 104. First level 104 includes a plurality of signal pins 106-112, each having ends proximate to a distal end 118 of level 104. Level 114 includes a distal end 120 and a proximal end 122. Base block 102 may be formed of a material known for use in USB-type connectors, such as for example any of various plastics having dielectric properties. Base block 102 may be molded as an integral unit including levels 104, 114 and signal pins 106-112. Alternatively, signal pins 106-112 may be affixed to level 104, and thereafter level 114 bonded to level 104 in an offset configuration as shown. While an embodiment of the present invention described herein includes a split level base block, it is understood that the ESD grounding clip described hereinafter may be used with other USB connector designs that do not include a split level base block.

Signal pins 106-112 may be conventional signal pins found in a type-A USB connector. Pin 106 may be a signal power pin for supplying a voltage to a semiconductor device to which USB connector 100 is attached as explained hereinafter. Signal pins 108 and 110 may transmit signals between the semiconductor device and a host device to which USB connector 100 is connected. Pin 112 may be a signal ground pin providing the semiconductor device with a path to ground. Each of pins 106-112 may be exposed on a surface of the first level 104 of the connector 100. The signal pins 106-112 may be buried within a portion of connector 100 where levels 104 and 114 overlap, and the pins may be exposed at a bottom surface 124 of level 114. A proximal end of each of the pins may extend past the proximal end 122 of level 114 as shown for signal ground pin 112 in FIG. 4 and for each of the pins in FIG. 5. The proximal portions of pins 106-112 are used to solder the pins to a printed circuit board of the semiconductor device as explained hereinafter.

Base block 102 includes a recessed portion 130 formed in level 114. In embodiments, recess 130 may be formed over the signal ground pin and along a length of the signal ground pin. However, recess 130 may be formed at other locations in level 114 in alternative embodiments explained hereinafter. As best seen in the edge view of FIG. 6, recess 130 may extend partially down through base block 102 a distance, d, so that no portion of the signal ground pin 112 beneath the recess 130 is exposed. As explained hereinafter, in alternative embodiments, recess 130 may extend down to a depth where portions of signal ground pin 112 are exposed within recess 130. In embodiments, recess 130 may be open to the proximal end 122 of level 114 but does not extend to the distal end 120 of layer 114 as shown. In alternative embodiments, recess 130 may extend all the way to distal end 120 of layer 114. In a further alternative embodiment explained hereinafter, recess 130 may be omitted altogether.

An ESD grounding clip 134 may be affixed within recess 130. Grounding clip 134 may be formed of aluminum, copper, other metals and alloys thereof. Clip 134 may or may not be plated. In an embodiment, ESD grounding clip 134 may include a proximal end 136 which is physically and electrically coupled to a proximal end of signal ground pin 112, such as for example by solder 138 (shown in FIGS. 4 and 5). Other methods of electrically and physically coupling clip 134 to the proximal end of signal ground pin 112 are contemplated. In embodiments, clip 134 may include a fulcrum point 140 (best seen in FIG. 6) to form clip 134 into a cantilever capable of flexing. Clip 134 may further include a portion 144 protruding outside of recess 130 as seen in FIGS. 4 and 6. Portion 144 is provided to engage a shroud mounted around base block 102 as explained hereinafter.

Recess 130 and ESD grounding clip 134 are shown aligned over signal ground pin 112, and clip 134 is shown connected to ground pin 112 at a proximal end of pin 112. However, in alternative embodiments, it is understood that clip 134 may be electrically coupled to signal ground pin 112 with the recess 130 and clip 134 positioned at other locations within level 114 of base block 102. The recess 130 and clip 134 may be located over one or more of pins 106, 108 and 110. Recess 130 and clip 134 may or may not be parallel to pins 106-112. Furthermore, while clip 134 is shown as a substantially straight length of metal (when viewed from the top of FIG. 5), it is understood that recess 130 and clip 134 may have curved or rounded edges when viewed from the top in further embodiments.

Similarly, it is understood that clip 134 may be physically and/or electrically coupled to signal ground pin 112 at locations other than the proximal end of pin 112. For example, as shown in the edge view of FIG. 7, recess 130 may extend all the way through level 114 to signal ground pin 112 so that signal ground pin 112 is exposed at the bottom of recess 130. In such an embodiment, clip 134 may be physically and/or electrically coupled to a variety of positions along the length of signal ground pin 112 within level 114 of base block 102. In a further embodiment shown in the edge view of FIG. 8, recess 130 may have first portions extending down through level 114 a first distance, d1, and a second portion extending all the way through level 114 a second distance, d2 (so that the signal ground pin 112 is exposed at the second portion of the recess). In such embodiments, clip 134 may be physically and electrically coupled to signal ground pin 112 where pin 112 is exposed within recess 130.

Figure 9:
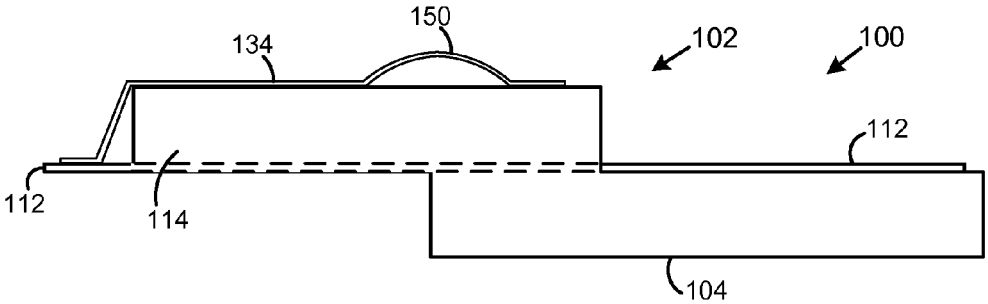
FIG. 9 is an edge view of a USB plug without a shroud according to a further alternative embodiment of the present invention.

Moreover, in a further embodiment shown in the edge view of FIG. 9, recess 130 may be omitted altogether. In the embodiment of FIG. 9, ESD grounding clip 134 may be directly affixed anywhere on the surface of level 114, and have a proximal end electrically coupled to the proximal end of signal ground pin 112 as described above. In such an embodiment, ESD grounding clip 134 may include a protruding portion 150 extending above the surface of level 114.

Figure 10:
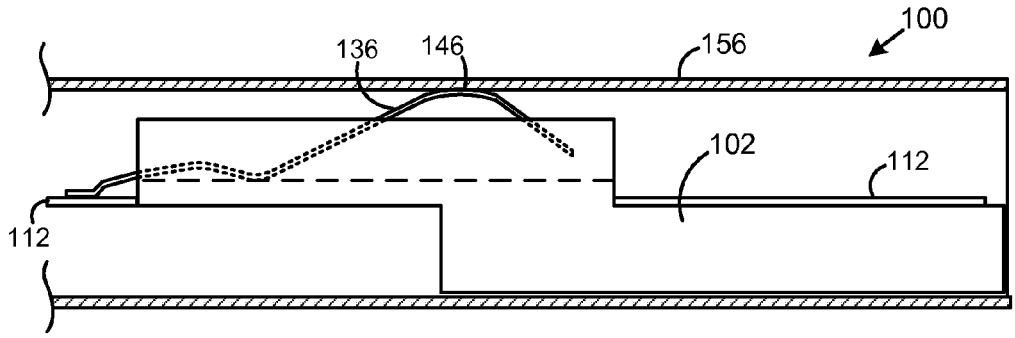
FIG. 10 is a cross-sectional edge view of a USB plug according to an embodiment of the present invention.

Referring now to the cross-sectional edge view of FIG. 10, a shroud 156 may be affixed around base block 102 and ESD grounding clip 136. Shroud 156 may be a protective metal cover as is known in the art, and base block 102 may be mounted within shroud 156 as is known in the art. In embodiments, portion 146, 150 of clip 136 is provided at a height above the surface of base block 102 such that, as shroud 156 is slid around the base block, the shroud slightly compresses the portion 146, 150 downward.

The cantilevered mounting of clip 136 to base block 102, and the elastic nature of clip 136, results in portion 146 remaining in pressure contact against shroud 156. Accordingly, any electrostatic discharge built up in the shroud 156 travels from the shroud, through the ESD grounding clip 136, to the signal ground pin 112 where it is harmlessly dissipated. While ESD grounding clip 136 is described in embodiments above as being cantilevered to base block 102, clip 136 need not be cantilevered in alternative embodiments.

Figure 11:
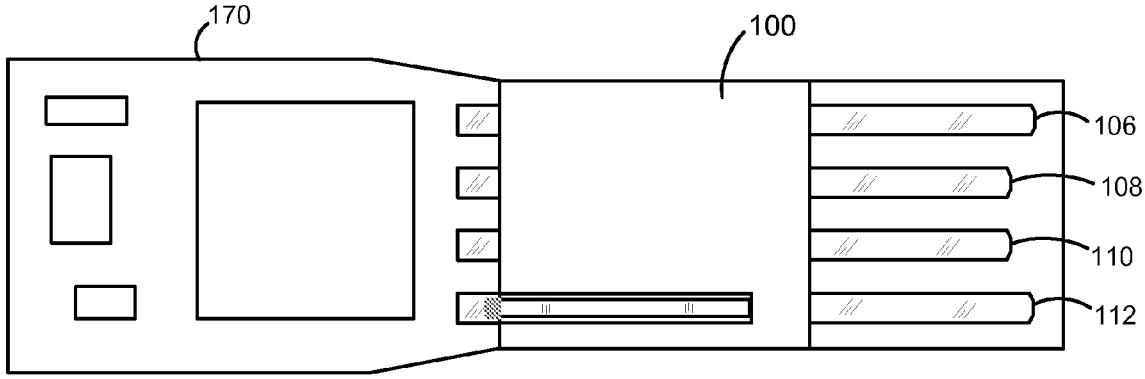
FIG. 11 is a top view of a USB semiconductor device without a shroud according to an embodiment of the present invention.
Figure 12:
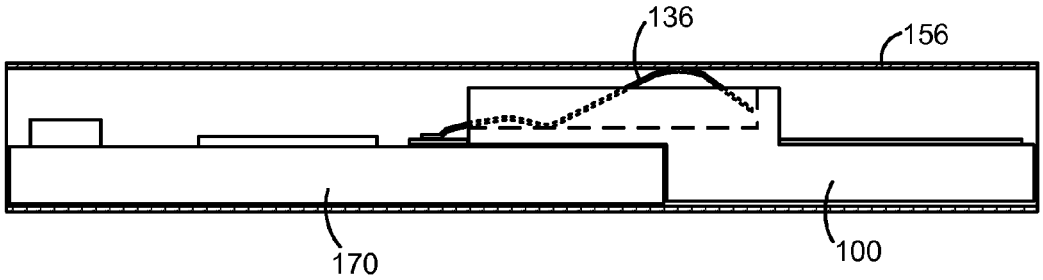
FIG. 12 is a cross-sectional edge view of a USB semiconductor device according to an embodiment of the present invention.

FIG. 11 is a top view of connector 100 affixed to a semiconductor device 170. As shown, pins 106, 108, 110 and 112 are affixed to semiconductor device 170 at their proximal ends, such as for example by soldering or other known electrical coupling methods. As seen in the cross-sectional edge view of FIG. 12, semiconductor device 170 and connector 100 may both be enclosed within shroud 156. In embodiments, semiconductor device 170 may be encased in molding compound and the encased semiconductor device then mounted within shroud 156. Where semiconductor device 170 is encased in molding compound, the shroud may only cover the connector 100. The type and function of semiconductor device 170 is not critical to the present invention, but may in embodiments be a flash memory device including one or more flash memory die and one or more controller die such as an ASIC.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. An electrical connector for affixing a portable semiconductor memory device to a host device, the electrical connector capable of fitting within an electrically conductive shroud, and the electrical connector and shroud capable of fitting within a receptacle of the host device, the electrical connector comprising:

a plurality of signal pins coupled to the portable semiconductor memory device for communicating signals between the portable semiconductor memory device and the host device, the plurality of signal pins including a signal ground pin; and a grounding clip electrically coupled to the signal ground pin and capable of physically engaging the shroud.

2. An electrical connector as recited in claim 1, wherein the grounding clip is physically affixed to a portion of the signal ground pin.

3. An electrical connector as recited in claim 1, wherein the grounding clip includes a substantially straight length of metal and a bend capable of physically engaging the shroud.

4. An electrical connector as recited in claim 1, wherein the grounding clip is a cantilevered spring extending from the signal ground pin.

5. An electrical connector as recited in claim 1, wherein the grounding clip is soldered to the signal ground pin.

6. An electrical connector for affixing a portable semiconductor memory device to a host device, the electrical connector capable of fitting within an electrically conductive shroud, and the electrical connector and shroud capable of fitting within a receptacle of the host device, the electrical connector comprising:

a plurality of signal pins coupled to the portable semiconductor memory device for communicating signals between the portable semiconductor memory device and the host device, the plurality of signal pins including a signal ground pin;

an encapsulant encapsulating at least a portion of the plurality of signal pins; and a grounding clip electrically coupled to the signal ground pin and positioned on a surface of the encapsulant, a portion of the grounding clip capable of physically engaging the shroud.

7. An electrical connector as recited in claim 6, wherein the grounding clip is affixed to an outer surface of the encapsulant.

8. An electrical connector as recited in claim 6, wherein the encapsulant is formed with a recess, the grounding clip residing within the recess.

9. An electrical connector as recited in claim 8, wherein the grounding clip is physically affixed to a portion of the signal ground pin.

10. An electrical connector as recited in claim 6, wherein the portion of the grounding clip capable of physically engaging the shroud comprises a bend capable of physically engaging the shroud.

11. An electrical connector as recited in claim 6, wherein the grounding clip is capable of dissipating static electricity from within the shroud.

12. An electrical connector as recited in claim 6, wherein the grounding clip is soldered to the signal ground pin.

13. A USB-type electrical connector for affixing an electronic device to a host device, the electrical connector comprising:

a plurality of signal pins coupled to the electronic device, the plurality of signal pins including a signal ground pin;

an encapsulant encapsulating at least a portion of the plurality of signal pins;

an electrically conductive shroud provided around at least a portion of the encapsulant and plurality of signal pins, the shroud capable of fitting within a receptacle of the host device, and a grounding clip physically biased against the shroud for electrically coupling the signal ground pin to the shroud.

14. An electrical connector as recited in claim 13, wherein the grounding clip is the sole electrical coupling between the signal ground pin and the shroud.

15. An electrical connector as recited in claim 13, wherein the grounding clip is affixed to an outer surface of the encapsulant.

16. An electrical connector as recited in claim 13, wherein the encapsulant is formed with a recess, the grounding clip residing within the recess.

17. An electrical connector as recited in claim 16, wherein the grounding clip is physically affixed to a portion of the signal ground pin.

18. An electrical connector as recited in claim 13, wherein the grounding clip includes a substantially straight length of metal and a bend capable of physically engaging the shroud.

19. A USB-type electrical connector for affixing a portable semiconductor memory device to a host device, the electrical connector comprising:

a plurality of signal pins coupled to the electronic device, the plurality of signal pins including a signal ground pin;

an encapsulant encapsulating at least a portion of the plurality of signal pins, the encapsulant including a recess aligned proximately to the signal ground pin;

an electrically conductive shroud provided around at least a portion of the encapsulant and plurality of signal pins, the shroud capable of fitting within a receptacle of the host device, and a grounding clip within the recess and affixed to the signal ground pin, the grounding clip including a bend in physical contact and physically biased against the shroud for electrically coupling the signal ground pin to the shroud.

20. An electrical connector as recited in claim 19, wherein the grounding clip is the sole electrical coupling between the signal ground pin and the shroud.

* * * * *